US009691329B2

(12) United States Patent
Kwon et al.

(10) Patent No.: US 9,691,329 B2
(45) Date of Patent: Jun. 27, 2017

(54) ORGANIC LIGHT EMITTING DISPLAY DEVICE CONFIGURED TO MEASURE DETERIORATION INFORMATION, AND DRIVING METHOD THEREOF

(71) Applicants: SAMSUNG DISPLAY CO., LTD., Yongin, Gyeonggi-do (KR); KOREA ADVANCED INSTITUTE OF SCIENCE AND TECHNOLOGY, Daejeon (KR)

(72) Inventors: Oh-Jo Kwon, Yongin (KR); Won-Tae Choi, Yongin (KR); Hee-Sun Ahn, Yongin (KR); Bo-Yeon Kim, Yongin (KR); Gyu-Hyeong Cho, Daejeon (KR); Hyun-Sik Kim, Daejeon (KR); Jun-Suk Bang, Daejeon (KR)

(73) Assignees: Samsung Display Co., Ltd., Yongin-si (KR); Korea Advanced Institute of Science and Technology, Daejeon (KR)

( * ) Notice: Subject to any disclaimer, the term of this patent is extended or adjusted under 35 U.S.C. 154(b) by 248 days.

(21) Appl. No.: 13/929,722

(22) Filed: Jun. 27, 2013

(65) Prior Publication Data

US 2014/0204071 A1 Jul. 24, 2014

(30) Foreign Application Priority Data

Jan. 24, 2013 (KR) ..... 10-2013-0008050

(51) Int. Cl.
*G09G 3/30* (2006.01)
*G09G 3/3291* (2016.01)
*G09G 3/3233* (2016.01)

(52) U.S. Cl.
CPC ..... *G09G 3/3291* (2013.01); *G09G 3/3233* (2013.01); *G09G 2300/0819* (2013.01);
(Continued)

(58) Field of Classification Search
CPC .. G09G 3/3275; G09G 3/3283; G09G 3/3291; G09G 2310/027
(Continued)

(56) References Cited

U.S. PATENT DOCUMENTS

2006/0139264 A1* 6/2006 Choi et al. ..... 345/76
2007/0024543 A1* 2/2007 Chung et al. ..... 345/76
(Continued)

FOREIGN PATENT DOCUMENTS

CN 1822732 A 8/2006
CN 101354864 A 1/2009
(Continued)

OTHER PUBLICATIONS

Shin, Dong-Yong et al., "Reducing image sticking in AMOLED displays with time-ratio gray scale by analog calibration," Journal of the SID, vol. 17, No. 9, 2009, pp. 705-713.

*Primary Examiner* — Ram Mistry
(74) *Attorney, Agent, or Firm* — Lewis Roca Rothgerber Christie LLP

(57) ABSTRACT

An organic light emitting display device includes pixels positioned at crossing regions between data lines and scan lines, each of the pixels including an organic light emitting diode, a scan driver configured to supply a scan signal to scan lines, a data driver configured to drive the data lines, wherein the data driver includes, in each channel, a supply part comprising a digital-to-analog converter configured to generate data signals using second data supplied from outside in a driving period, and a deterioration part configured to measure deterioration information of the organic light emitting diode using the digital-to-analog converter in a sensing period.

19 Claims, 7 Drawing Sheets

(52) U.S. Cl.
CPC ..... *G09G 2300/0842* (2013.01); *G09G 2300/0861* (2013.01); *G09G 2320/0295* (2013.01); *G09G 2320/0693* (2013.01)

(58) Field of Classification Search
USPC ..... 345/36, 39, 44–46, 74.1–83; 315/169.3; 313/463
See application file for complete search history.

(56) References Cited

U.S. PATENT DOCUMENTS

| | | | | |
|---|---|---|---|---|
| 2008/0036703 | A1* | 2/2008 | Wang et al. | 345/76 |
| 2008/0252568 | A1* | 10/2008 | Kwon | G09G 3/3233 345/76 |
| 2009/0051628 | A1* | 2/2009 | Kwon | G09G 3/3233 345/77 |
| 2011/0007067 | A1 | 1/2011 | Ryu et al. | |

FOREIGN PATENT DOCUMENTS

| | | | |
|---|---|---|---|
| CN | 101488319 | A | 7/2009 |
| CN | 101615379 | A | 12/2009 |
| KP | 10-2011-0005500 | | 1/2011 |
| KR | 10-0846970 | | 7/2008 |
| KR | 10-2009-0020190 | | 2/2009 |

* cited by examiner

ORGANIC LIGHT EMITTING DISPLAY DEVICE CONFIGURED TO MEASURE DETERIORATION INFORMATION, AND DRIVING METHOD THEREOF

CROSS-REFERENCE TO RELATED APPLICATION

This application claims priority to and the benefit of Korean Patent Application No. 10-2013-0008050, filed on Jan. 24, 2013, in the Korean Intellectual Property Office, the entire content of which is incorporated herein by reference.

BACKGROUND

1. Field

The present invention relates to an organic light emitting display device and a driving method thereof.

2. Description of the Related Art

Recently, various flat panel display devices having reduced weight and volume, as compared to cathode ray tubes, have been developed. Examples of flat panel display devices include liquid crystal displays, field emission displays, plasma display panels, organic light emitting display devices, and the like.

An organic light emitting display device displays an image using organic light emitting diodes for generating light by recombination between electrons and a holes. The organic light emitting display device as described above, has advantages in that it has a rapid response speed and is driven at low power.

Generally, an organic light emitting display device displays a desired image while it supplies current corresponding to grayscale to an organic light emitting diode (OLED) disposed in every pixel. However, the organic light emitting diode may deteriorate over time, leading to a problem that an image with a desired brightness may not be displayed. For example, as the organic light emitting diode gradually deteriorates, the same data signal generates lower brightness light.

To solve the problem above, by using an analog-to-digital converter (hereinafter, referred to as an "ADC"), a deterioration voltage of the organic light emitting diode is measured, and a method for compensating the deterioration of the organic light emitting diode is proposed.

However, in the related art, the ADC is generally formed at each channel, which may result in high additional manufacturing cost and a wide (or large) mounting area. In order to overcome these disadvantages as described above, the ADC may be shared by a plurality of channels, but that has another disadvantage in that a large amount of time may be used for measuring deterioration.

SUMMARY

An aspect of the present invention is to provide an organic light emitting display device capable of improving display quality by compensating for the deterioration of an organic light emitting diode, and to provide a driving method thereof.

Another aspect of the present invention is to provide an organic light emitting display device capable of reducing manufacturing cost and mounting area while ADCs are formed on each channel, and to provide a driving method thereof.

According to one aspect of the present invention, there is provided an organic light emitting display device including:

pixels positioned at crossing regions between data lines and scan lines, each of the pixels including an organic light emitting diode; a scan driver configured to supply a scan signal to scan lines; a data driver configured to drive the data lines; wherein the data driver includes, in each channel, a supply part including a digital-to-analog converter configured to generate data signals using second data supplied from outside in a driving period; and a deterioration part configured to measure deterioration information of the organic light emitting diode using the digital-to-analog converter in a sensing period.

The supply part may include: a holding latch configured to store deterioration data from the deterioration part or the second data; a digital-to-analog converter configured to generate an analog voltage corresponding to either the deterioration data or a data signal corresponding to the second data; and a buffer configured to output the analog voltage or the data signal.

The deterioration data may be supplied in the sensing period.

The analog voltage generated by initial deterioration data which may be stored at the holding latch, may be set to be an intermediate voltage of the voltage generated in the digital-to-analog converter.

The organic light emitting display device may further include: a level shifter positioned between the holding latch and the digital-to-analog converter.

The deterioration part may include: a current source configured to supply a current to the organic light emitting diode through the data line in the sensing period; a comparator coupled to the buffer and the current source, and configured to compare the analog voltage with a deterioration voltage generated at the organic light emitting diode in response to the supplied current; and a controller configured to control a bit value of the deterioration data corresponding to the compared result of the comparator.

The controller may be configured to control the bit value of the deterioration data so that the analog voltage and the deterioration voltage are similar to each other.

The organic light emitting display device may further include: a memory configured to store the deterioration data, and a timing controller configured to generate the second data by changing a bit of first data so that a deterioration of the organic light emitting diode is compensated using the deterioration data.

The deterioration part may include: a current source configured to supply a current to the organic light emitting diode through the data line; a comparator coupled to the buffer and the current source, and configured to compare the analog voltage with a deterioration voltage generated at the organic light emitting diode according to the supplied current.

The organic light emitting display device may further include: a timing controller configured to supply second data to the holding latch in the driving period and to control a bit value of the deterioration data corresponding to the compared result of the comparator in the sensing period.

The timing controller may control a bit value of the deterioration data so that the analog voltage and the deterioration voltage are similar to each other.

The organic light emitting display device may further include a memory configured to store the deterioration data, and the timing controller may be configured to generate the second data by changing a bit of first data so that a deterioration of the organic light emitting diode is compensated using the deterioration data stored at the memory.

The deterioration data supplied from the timing controller may be supplied to the holding latch through a sampling latch.

The organic light emitting display device may further include: a switching unit connecting each data line to the supply part in the driving period, and to the deterioration part in the sensing period.

The switching unit may include, in each channel: a first switching device coupled between the supply part and the data line and turned on in the driving period, and a second switching device coupled between the deterioration part and the data line and turned on in the sensing period.

According to an aspect of the present invention, there is provided a method for driving an organic light emitting device including: measuring deterioration information of the organic light emitting diode included in each pixel, using a digital-to-analog converter positioned at each channel of a data driver in a sensing period; generating second data by changing first data from outside to compensate for a deterioration of the organic light emitting diode based on the deterioration information; and supplying the second data converted into a data signal using the digital-to-analog converter in the driving period, to a data line.

The measuring may further include: supplying deterioration data to the digital-to-analog converter and generating an analog voltage from the digital-to-analog converter; sensing a deterioration voltage applied to the organic light emitting diode while a current is applied to the organic light emitting diode; and controlling bits of the deterioration data so that the analog voltage and the deterioration voltage are similar to each other.

The method may further include: storing the deterioration data at a memory.

The supplied deterioration data may generate the analog voltage of an intermediate voltage at an output of the digital-to-analog converter.

BRIEF DESCRIPTION OF THE DRAWINGS

The accompanying drawings, together with the specification, illustrate example embodiments of the present invention, and, together with the description, serve to explain the principles of the present invention.

DETAILED DESCRIPTION

Figure 1:
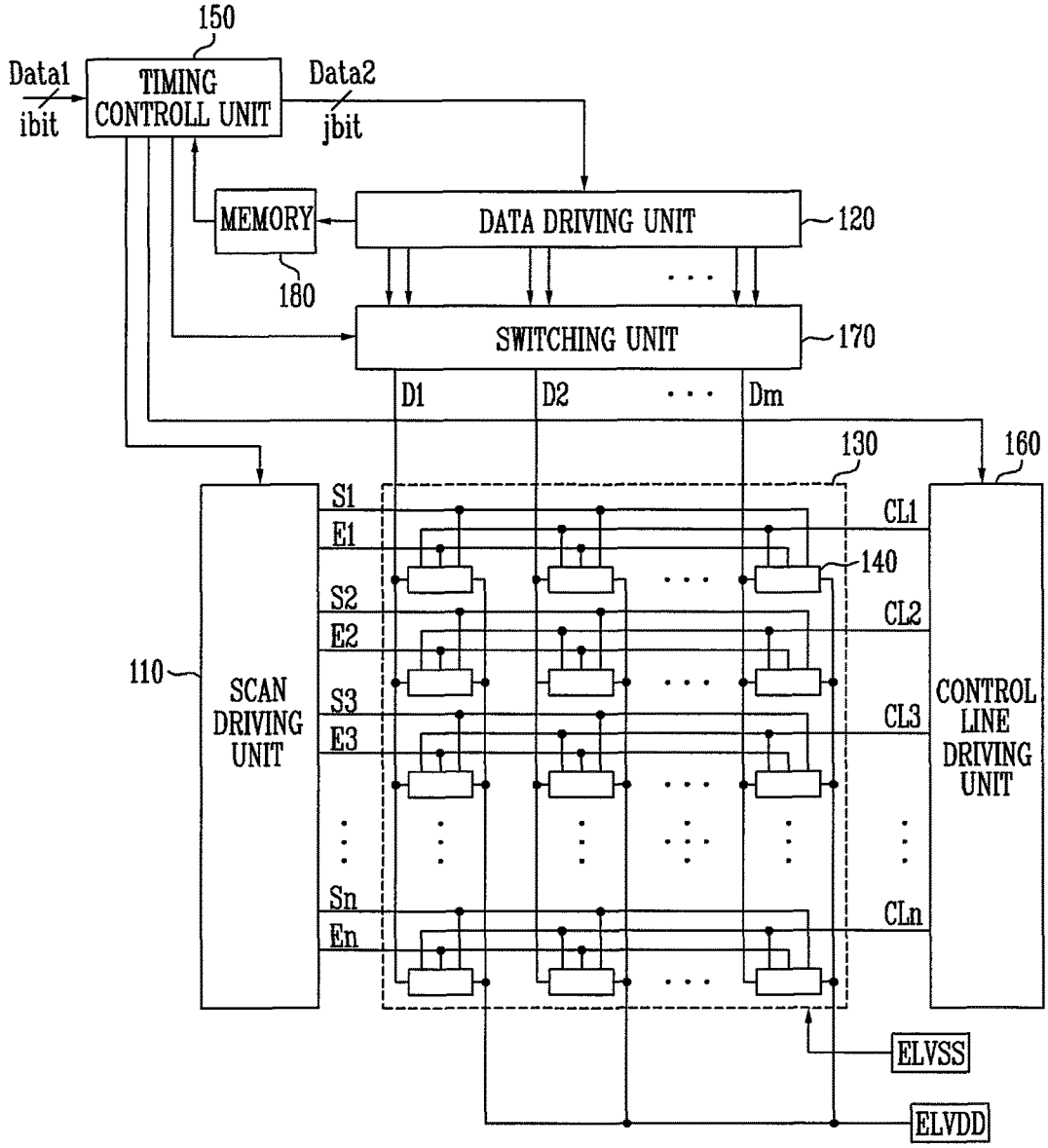
FIG. 1 is a diagram illustrating an organic light emitting display device, according to an example embodiment of the present invention.

Hereinafter, certain example embodiments of the present invention will be described with reference to the accompanying drawings. Here, when a first element is described as being coupled to a second element, the first element may be directly coupled to the second element or may be indirectly coupled to the second element via a third element. Further, some of the elements that are not essential to the complete understanding of the invention are omitted for clarity. Additionally, like reference numerals refer to like elements throughout.

Hereinafter, example embodiments of the present invention that may be practiced without undue experimentation by those of ordinary skill in the art to which the present invention pertains will be described in detail with reference to FIGS. 1 through 7.

FIG. 1 is a diagram illustrating an organic light emitting display device, according to an example embodiment of the present invention.

Referring to FIG. 1, the organic light emitting display device, according to some embodiments of the present invention, includes a pixel unit 130 including pixels 140 positioned at crossing regions between scan lines S1 to Sn and data lines D1 to Dm, a scan driving unit (or scan driver) 110 for driving the scan lines S1 to Sn and emission control lines E1 to En, and a control line driving unit (or control line driver) 160 for driving control lines CL1 to CLn.

The organic light emitting display device, according to an embodiment of the present invention, may further include: a data driving unit (or a data driver) 120 for measuring the deterioration voltage of an organic light emitting diode included in each pixel 140 and for driving the data lines D1 to Dm, a memory 180 for storing the deterioration data corresponding to the deterioration information, a switching unit 170 for selectively connecting the data lines D1 to Dm, and a timing control unit (or a timing controller) 150 for controlling the scan driving unit 110, the data driving unit 120, the control line driving unit 160, and the switching unit 170.

The pixel unit 130 includes the pixels 140 positioned at crossing regions of the scan lines S1 to Sn and the data lines D1 to Dm. Each of the pixels 140 receives a first power supply ELVDD and a second power supply ELVSS from the outside. The pixels 140, as described above, control the amount of current, which corresponds to the data signals, flowing from the first power supply ELVDD to the second power supply ELVSS through the organic light emitting diode.

The scan driving unit 110 sequentially supplies the scan signals to the scan lines S1 to Sn by controlling of the timing control unit 150. Additionally, the scan driving unit 110 supplies the emission control signals to emission control lines E1 to En by controlling of the timing control unit 150. Here, the emission control lines E1 to En may be omitted depending on the particular structure of the pixel 140.

The timing control unit 150 controls the control line driving unit 160, which sequentially supplies the control signals to the control lines CL1 to CLn. Here, the control signals are supplied during a sensing period in which the OLED deterioration information is measured in the pixels 140.

The data driving unit 120 includes a deterioration part (not illustrated) and a supply part (not illustrated) in each channel. The supply part may be used to supply data signals, corresponding to a second data Data2 supplied from the timing control unit 150, to a data line, which may be any one of data lines D1 to Dm. The deterioration part may be used to measure the deterioration of the organic light emitting diode included in each of the pixels 140. The deterioration part measures the deterioration information from the organic light emitting diode while sharing (or using) some of the components of the supply part. A detailed description thereof will be provided below.

The switching unit 170 selectively connects the data lines D1 to Dm to the deterioration part and the supply part, respectively. For example, the switching unit 170 couples (e.g., connects) the data lines D1 to Dm to the deterioration part in sensing period, and couples (e.g., connects) the data lines D1 to Dm to the supply unit in driving period. To this end, the switching unit 170 includes at least one switching device in each channel.

The memory 180 stores deterioration data corresponding to the deterioration information measured by the data driving unit 120. For example, the deterioration data, which is from each of the pixels 140 included in the pixel unit 130, may be stored in the memory 180.

The timing control unit 150 controls the scan driving unit 110, the data driving unit 120, the control line driving unit 160, and the switching unit 170. Additionally, the timing control unit 150 converts a bit value of the first data Data1 input from the outside to the second data Data2, to compensate for OLED deterioration, based on the deterioration data stored in the memory 180. Here, the first data Data1 comprises i bits (where ' ' is a natural number), and the second data Data2 comprises j bits (where 'j' is a natural number greater than ' ').

Figure 2:
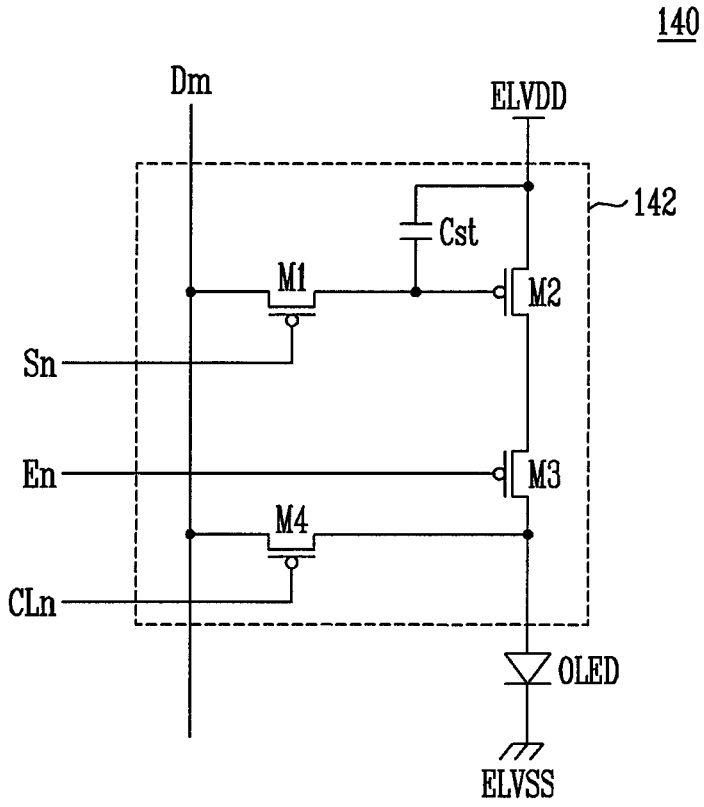
FIG. 2 is a schematic diagram illustrating a pixel, according to an example embodiment of the present invention.

FIG. 2 is a schematic diagram illustrating a pixel, according to an example embodiment of the present invention. In FIG. 2, the pixel coupled to an n-th scan line (Sn) and an m-th data line (Dm) will be described, for convenience of explanation.

Referring to FIG. 2, the pixel 140, according to an example embodiment of the present invention, includes an organic light emitting diode OLED and a pixel circuit 142 for supplying current to an organic light emitting diode OLED.

An anode electrode of an organic light emitting diode OLED is coupled to the pixel circuit 142, and a cathode electrode thereof is coupled to the second power supply ELVSS. The organic light emitting diode OLED, as described above, generates light having a brightness (e.g., a predetermined brightness) described above, generates the data signal having corresponding to current supplied from the pixel circuit 142.

The pixel circuit 142 receives the data signal supplied from the data line Dm when the scan signal is supplied to the scan line Sn. Further, the pixel circuit 142 receives a current (e.g., a predetermined current) from the data driving unit 120 when the control signal is supplied to the control line CLn. The current causes the pixel circuit 142 (more specifically, the OLED) to supply a deterioration voltage. To this end, the pixel circuit 142 includes four transistors M1 to M4 and a storage capacitor Cst.

A gate electrode of the first transistor M1 is coupled to the scan line Sn, and a first electrode thereof is coupled to the data line Dm. In addition, a second electrode of the first transistor M1 is coupled to a first terminal of the storage capacitor Cst. The first transistor M1 is turned on when the scan signal is supplied to scan line Sn. Here, a voltage corresponding to the data signal is charged at the storage capacitor Cst during the period in which the scan signals are applied to the first transistor M1.

A gate electrode of the second transistor M2 is coupled to the first terminal of the storage capacitor Cst, and a first electrode thereof is coupled to a second terminal of the storage capacitor Cst and to the first power supply ELVDD. The second transistor M2, as described above, controls the amount of current flowing from the first power supply ELVDD to the second power supply ELVSS through the organic light emitting diode OLED, wherein the amount of current corresponds to the voltage value stored at the storage capacitor Cst. Here, the organic light emitting diode OLED generates light corresponding to the amount of current supplied from the second transistor M2.

A gate electrode of the third transistor M3 is coupled to the emission control line En, and a first electrode thereof is coupled to the second electrode of the second transistor M2. In addition, the second electrode of the third transistor M3 is coupled to the organic light emitting diode OLED. The third transistor M3 is turned off when the emission control signal is supplied (e.g. when the emission control signal is high) to the emission control line En, and is turned on when the emission control signal is not supplied (e.g., when the emission control signal is low) thereto. Here, the emission control signals are supplied to the third transistor M3 in a period in which voltage corresponding to the data signal is charged in the storage capacitor Cst and in a sensing period in which the deterioration information of the organic light emitting diode OLED is sensed.

A gate electrode of the fourth transistor M4 is coupled to the control line CLn, and a first electrode thereof is coupled to the second electrode of the third transistor M3. A second electrode of the fourth transistor M4 is coupled to the data line Dm. The fourth transistor M4 is turned on when the control signal is supplied to the control line CLn, and is turned off otherwise. Here, the control signals are sequentially supplied to the control lines CL1 to CLn in the sensing period.

Meanwhile, a structure of the pixel 140, according to an embodiment of the present invention, is not limited to a description of FIG. 2, as described above. The pixel 140 may be configured in various forms so long as it includes the fourth transistor M4 for measuring the OLED deterioration information. For example, the pixel 140 may have any one of suitable configurations.

Figure 3:
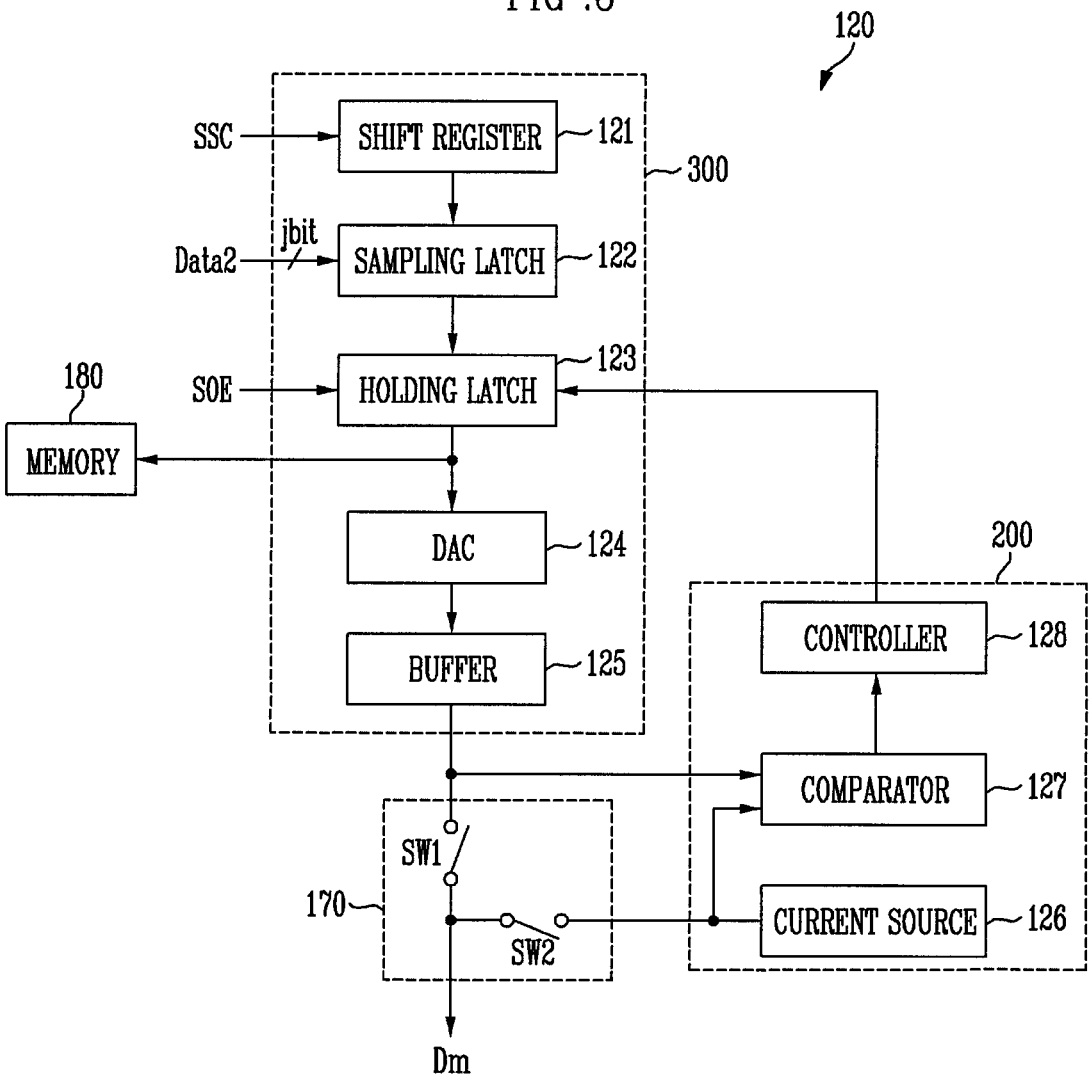
FIG. 3 is a diagram illustrating a data driving unit and a switching unit, according to an example embodiment of the present invention.

FIG. 3 is a diagram illustrating a data driving unit and a switching unit, according to an example embodiment of the present invention. In FIG. 3, one channel coupled to the m-th data line Dm will be described, for convenience of explanation.

Referring to FIG. 3, two switching devices SW1 and SW2 may be included in each channel of the switching unit 170, according to an embodiment of the present invention.

The first switching device SW1 is positioned between the supply part 300 and the data line Dm. The first switching device SW1 is turned on in a driving period in which the data signals are supplied from the supply part 300 to the data line Dm.

The second switching device SW2 is positioned between the deterioration part 200 and the data line Dm. The second switching device SW2 is turned on in the sensing period in which the deterioration information of the organic light emitting diode OLED is measured.

The data driving unit 120, according to an embodiment of the present invention, includes the deterioration part 200 and the supply part 300. The supply part 300 is used to supply the data signals to the data line Dm. To this end, the supply part 300 includes: a shift register 121, a sampling latch 122, a holding latch 123, a digital-to-analog converter (hereinafter, referred to as a "DAC") 124, and a buffer 125.

The shift register 121 supplies sampling signals to the sampling latch 122. For example, the multiple shift registers 121 shift a source start pulse (not illustrated) in one period of a source shift clock SSC, thereby sequentially supplying m sampling signals.

The sampling latch 122 stores the second data Data2 in response to the sampling signals. Here, the second data Data2 is bit-converted to compensate for OLED deterioration and supplied from the timing control unit 150.

The holding latch 123 receives the second data Data2 from the sampling latch 122 in response to the source output enable signal SOE, and stores the second data Data2. In addition, the holding latch 123 supplies the second data Data2, stored therein, to the DAC 124.

The DAC 124 generates an analog voltage (i.e., the data signal) corresponding to the second data Data2. Here, the DAC 124 controls the voltage of the data signal, corresponding to a bit value of the second data Data2, so as to implement gray levels.

The buffer 125 supplies the data signals supplied from the DAC 124 to the data line Dm.

The supply part 300, according to an embodiment of the present invention, as described above, generates the data signal having a voltage (e.g., a predetermined voltage) corresponding to the second data Data2 in the driving period, and supplies the generated data signal to the data line Dm.

The deterioration part 200 is used to measure the deterioration voltage of the organic light emitting diode OLED. Here, the deterioration part 200 measures the deterioration information of the organic light emitting diode OLED while sharing a part of the supply part 300 (for example, the DAC). To this end, the deterioration part 200 includes a current source 126, a comparator 127, and a controller 128.

The current source 126 supplies a current (e.g., a predetermined current) to the data line Dm when the second switching device SW2 is turned on. A current value supplied from the current source 126 is experimentally determined so that the deterioration of the organic light emitting diode OLED is stably measured. For example, the current source 126 may supply the current which will flow through the organic light emitting diode OLED, when the pixel 140 is emitting with maximum brightness.

The comparator 127 compares the voltage sensed from the organic light emitting diode OLED, corresponding to the current supplied from the current source 126, and the voltage applied from the buffer 125, and then, supplies the compared result to the controller 128.

The controller 128 supplies the deterioration data to the holding latch 123 so that an intermediate voltage may be generated in the DAC 124 in an initial period of the sensing period. And then, the controller 128 controls the deterioration data corresponding to the compared result of the comparator 127, so that the voltage of the buffer 125 and the voltage of the organic light emitting diode OLED are similar to each other. Therefore, bits of the deterioration data stored in the holding latch 123 is changed corresponding to the deterioration of the organic light emitting diode OLED.

Meanwhile, the deterioration part 200, according to an embodiment of the present invention, measures the OLED deterioration information while sharing the configuration of the holding latch 123, the DAC 124, and the buffer 125 included in the supply part 300. In this manner, the deterioration part 200 may assume a simple configuration; therefore, the manufacturing cost and the mounting area may be reduced or minimized.

Generally, the ADC includes a comparator, a controller and a DAC. The ADC of the deterioration part 200 is implemented using the DAC 124 of the supply part 300, in an embodiment of the present invention. Typically, the DAC comprises most of the manufacturing cost and the mounting area of an ADC, however, by sharing the DAC 124, in these embodiments of the present invention, the manufacturing cost and the mount area may be reduced or minimized while the deterioration part 200 is formed on each channel (i.e., including the ADC for measuring the deterioration).

Figure 4:
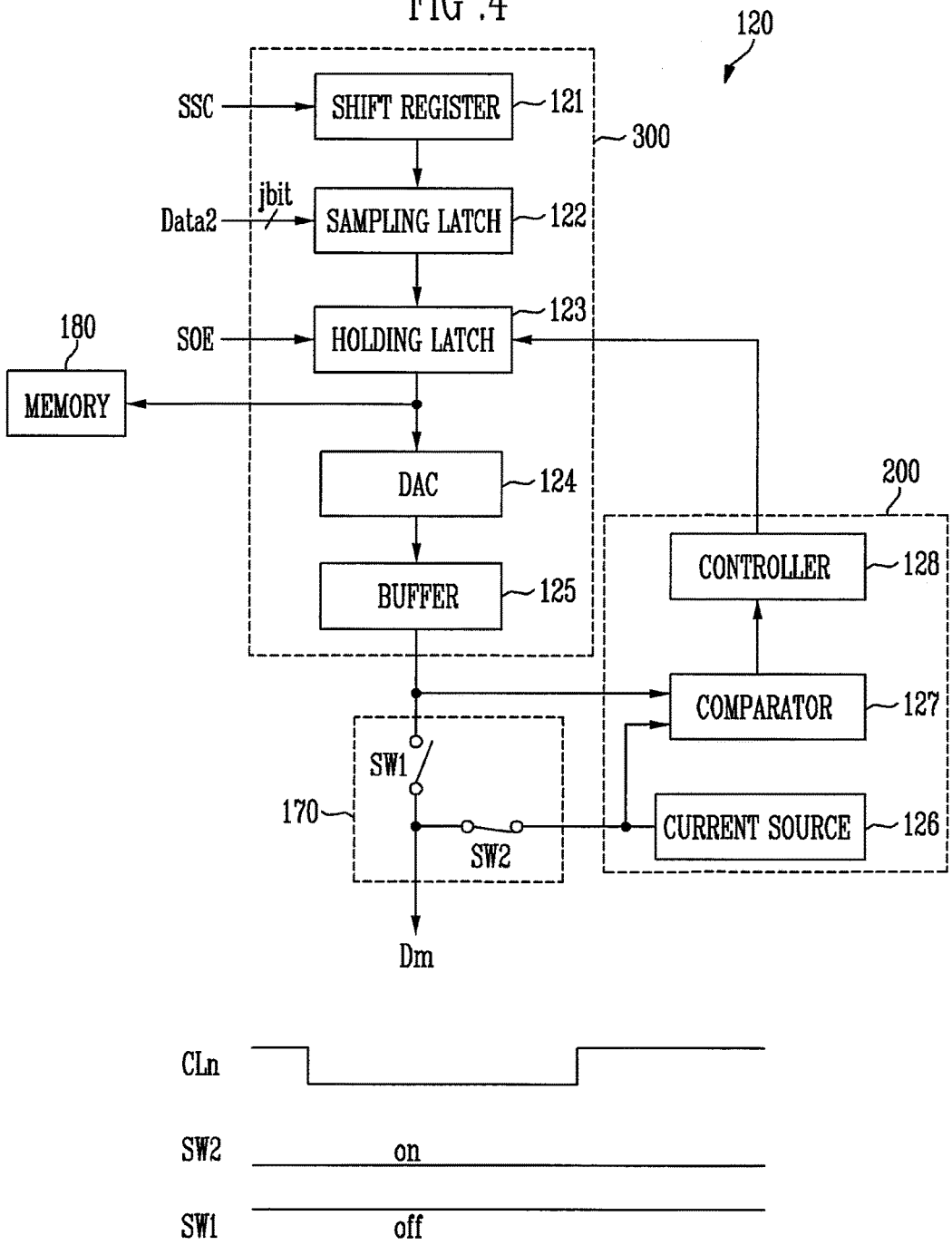
FIG. 4 is a diagram illustrating an operating process in a sensing period, according to an example embodiment of the present invention.

FIG. 4 is a diagram illustrating an operating process in a sensing period, according to an embodiment of the present invention. In FIG. 4, a process of measuring the OLED deterioration information on the pixel 140, which is positioned at a n-th horizontal line and coupled to the m-th data line Dm, will be described, for convenience of description.

Referring to FIGS. 2 and 4, the process of driving a data signal will be described. First, during the sensing period, the control signal is supplied to the control line CLn and then the fourth transistor M4 is turned on. When the fourth transistor M4 is turned on, the data line Dm and an anode electrode of the organic light emitting diode OLED are electrically coupled to each other.

In addition, during the sensing period, the second switching device SW2 is turned on, and the first switching device SW1 is set to be turned off. In addition, the controller 128 stores deterioration data on the holding latch 123 in an initial period of the sensing period, so that an intermediate voltage of the voltage to be generated in the DAC 124 is generated. Therefore, the DAC 124 outputs the intermediate voltage to the buffer 125 corresponding to the deterioration date.

During the sensing period, when the second switching device SW2 is turned on, a current (e.g., a predetermined current) is supplied to the second power supply ELVSS through the data lines Dm and the organic light emitting diode OLED. Then, a deterioration voltage, corresponding to the current is sensed at the anode electrode of the organic light emitting diode OLED.

The comparator 127 compares the voltage output from the buffer 125 with the deterioration voltage, and then the compared result is supplied to the controller 128. The controller 128 controls bits of the deterioration data stored at the holding latch 120 so that the voltage output from the buffer 125 is similar to (or same as) the deterioration voltage. For example, the controller 128 controls an output voltage from the buffer 125 by controlling the bits of the deterioration data more than one time.

In addition, the deterioration data output from the holding latch 123 is stored at the memory 180. Here, the deterioration data includes the deterioration information of the organic light emitting diode OLED. Typically, the more deteriorated the organic light emitting diode OLED is, the more its resistance value increases, therefore, the sensed OLED resistive voltage (i.e., the deterioration voltage), may change according to the degree of deterioration. In this embodiment, the deterioration data which has a bit value is controlled so as to generate a voltage similar to the deterioration voltage at the DAC 124.

In an embodiment of the present invention, the control signals are sequentially supplied to the control lines CL1 to CLn in the sensing period and the OLED deterioration information of the pixels 140 is measured, and then the corresponding deterioration data is stored at the memory 180.

Figure 5:
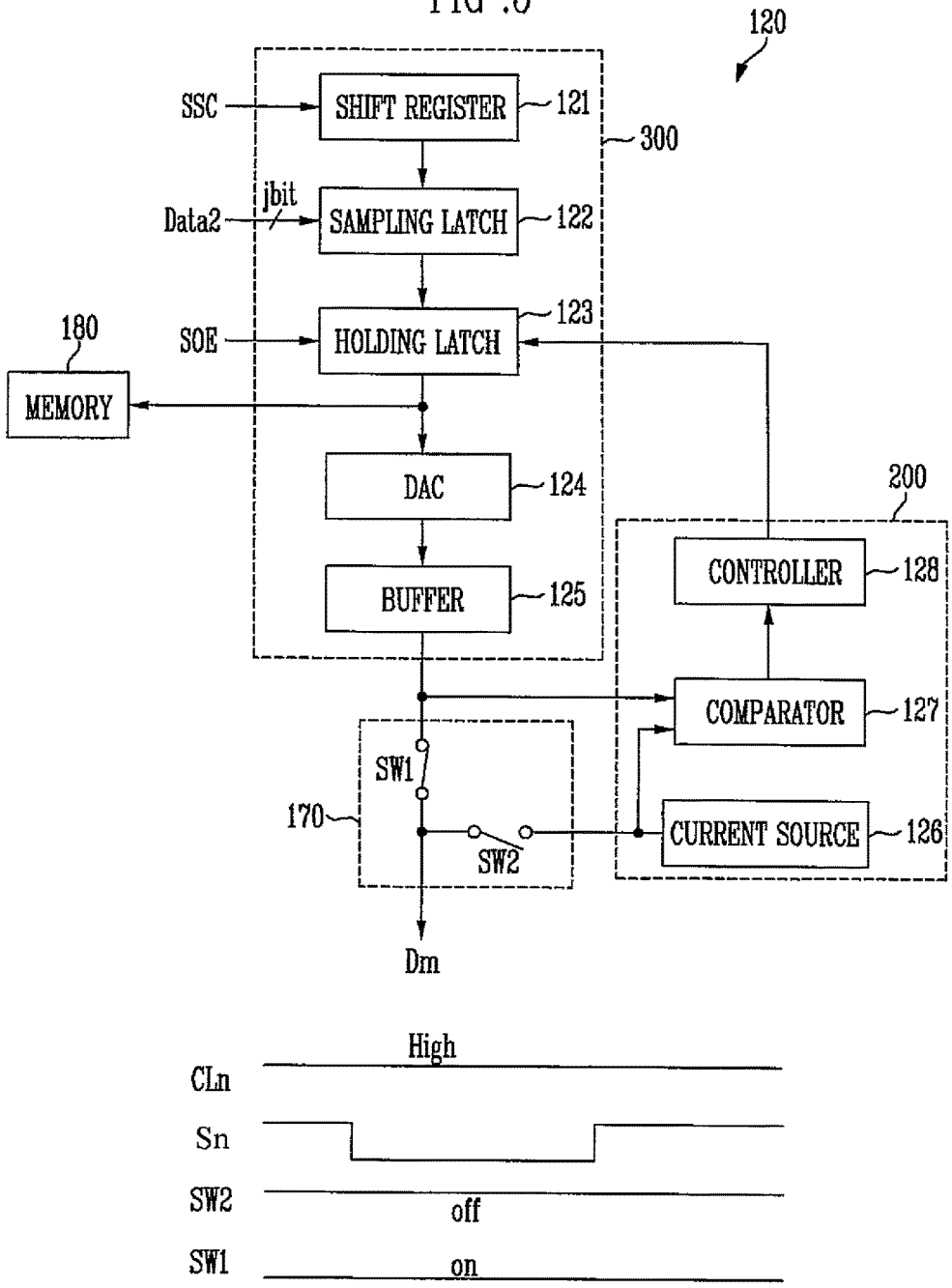
FIG. 5 is a diagram illustrating an operating process in a driving period, according to an example embodiment of the present invention.

FIG. 5 is a diagram illustrating an operating process in a driving period, according to an embodiment of the present invention. In FIG. 5, a process of supplying the data signals to the pixel 140, which is positioned at a n-th horizontal line and coupled to the m-th data line Dm, will be described, for convenience of description.

Referring to FIGS. 2 and 5, the process will be described, during the driving period, when the control signal is not supplied to the control line CLn but the scan signal is supplied to the scan line Sn. When the scan signal is supplied to the scan line Sn, the first transistor M1 is turned on. When the first transistor M1 is turned on, the gate electrode and the data line Dm of the second transistor M2 are electrically coupled to each other. In addition, during the driving period, the second switching device SW2 is turned off, and the first switching device SW1 is turned on. When the first switching device SW1 is turned on, the buffer 125 and the data line Dm are electrically coupled to each other.

During the driving period, the timing control unit 150 converts a bit value of the first data Data1 to the second data Data2, to compensate for the deterioration of the OLED, based on the deterioration data stored at the memory 180. The second data Data2, generated from the timing control unit 150, is stored at the sampling latch 122 in response to the sampling signal supplied from the shift register 121.

The second data Data2 stored at the sampling latch 122 is supplied to the DAC 124 through the holding latch 123. Then, the DAC 124 generates the data signal having a voltage (e.g., a predetermined voltage) corresponding to the second data Data2, and supplies the generated data signal to the buffer 125. The data signal supplied to the buffer 125 is supplied to the gate electrode of the second transistor M2 through the data line Dm. At this time, the storage capacitor Cst is charged with a voltage (e.g., predetermined voltage) corresponding the data signal. And then, second transistor M2 controls the amount of current supplied to the organic light emitting diode OLED according to the voltage stored at the storage capacitor Cst.

During the driving period, the data signals are supplied to the data lines D1 to Dm as the scan signals are sequentially supplied to the scan lines S1 to Sn. Therefore, light, having a brightness (e.g., a predetermined brightness) corresponding to the data signal, is generated in each pixel 140. Here, since the data signal is generated by the second data Data2, light having desired brightness may be generated in each channel, regardless of OLED deterioration.

Figure 6:
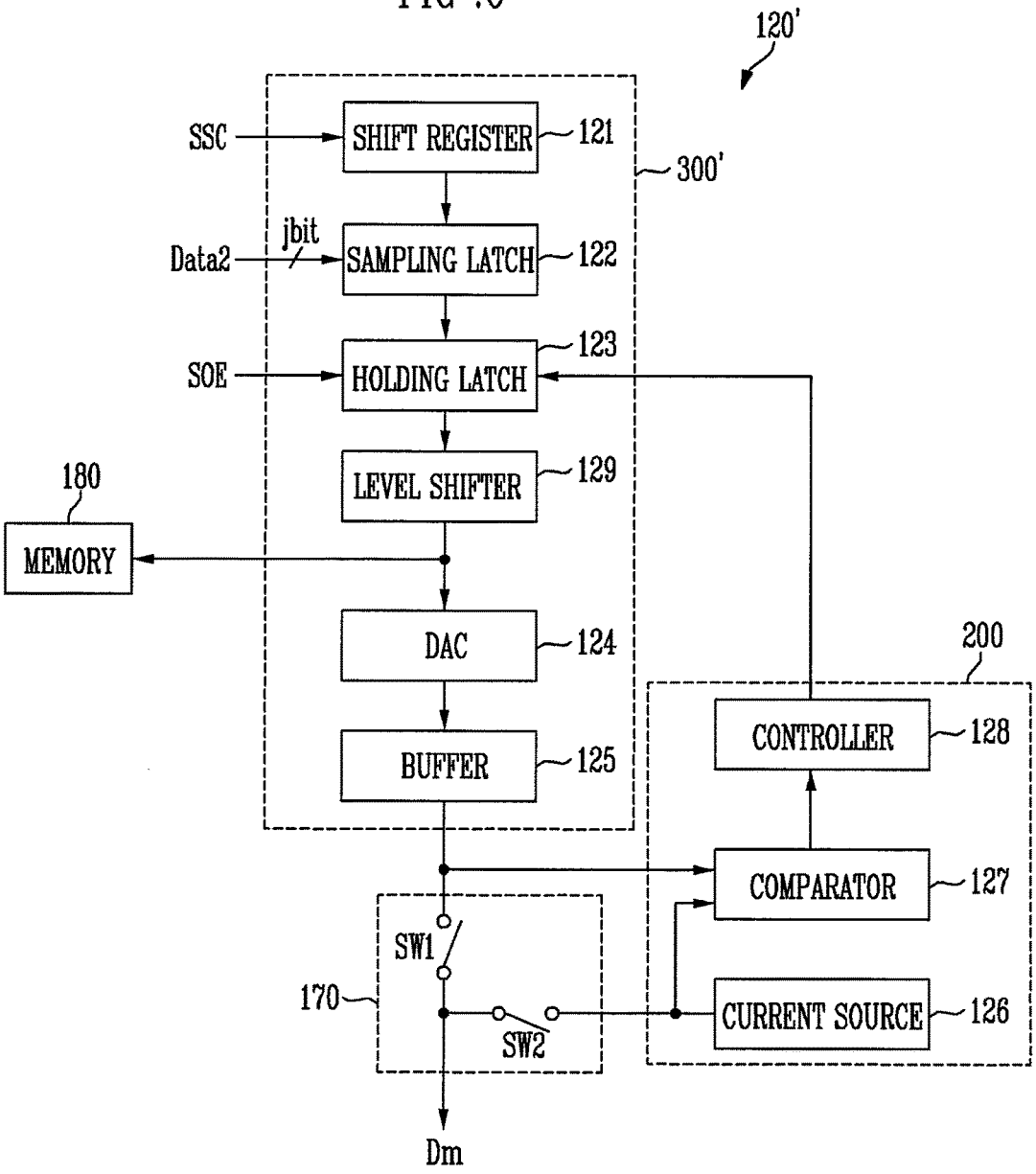
FIG. 6 is a diagram illustrating a data driving unit, according to an example embodiment of the present invention.

FIG. 6 is a diagram illustrating a data driving unit, according to another example embodiment of the present invention. When FIG. 6 is described, all elements that are similar to, or same as, those of FIG. 3 will be given the same reference numerals and a repeat of their detailed description will not be provided.

Referring to FIG. 6, the data driving unit 120', according to another present invention, includes the supply part 300' and the deterioration part 200.

The supply part 300', according to another embodiment of the present invention, further includes a level shifter 129 positioned between the holding latch 123 and the DAC 124. The level shifter 129 allows the increase of the voltage level of the deterioration data supplied from the holding latch 123. The level shifter 129 controls the voltage level (e.g., high or low) of the deterioration data so as to make the bit value of each deterioration data become clear. Except for the addition of the shifter 129, the data driving unit 120' is the same as that of FIGS. 4 and 5, therefore, further detailed description will not be provided.

Figure 7:
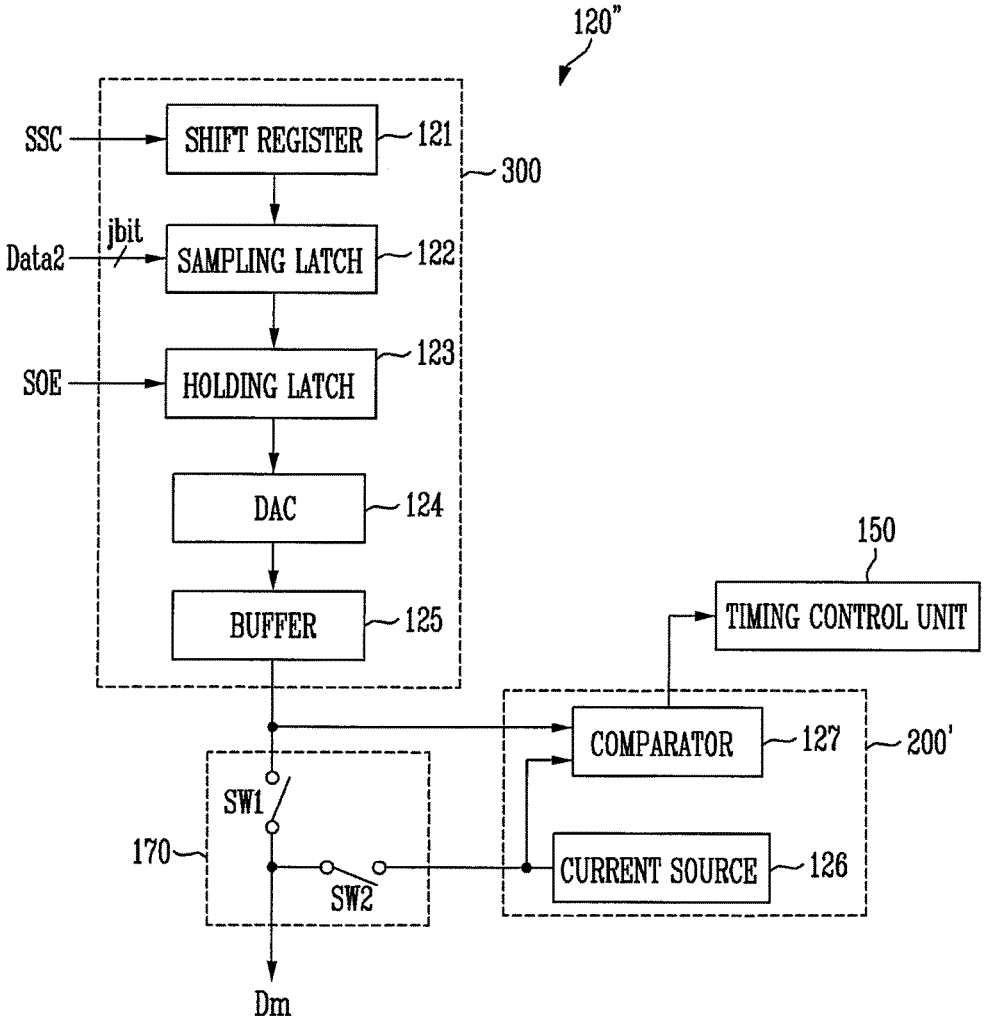
FIG. 7 is a diagram illustrating a data driving unit, according to another example embodiment of the present invention.

FIG. 7 is a diagram illustrating a data driving unit, according to another example embodiment of the present invention. When FIG. 7 is described, all elements that are similar to, or same as, those of FIG. 3 will be given the same reference numerals and a repeat of their detailed description will not be provided.

Referring to FIG. 7, the data driving unit 120", according to still another embodiment of the present invention, includes the supply part 300 and a deterioration part 200'.

The deterioration part 200', according to another embodiment of the present invention, includes a current source 126 and a comparator 127. That is, the controller 128 of FIG. 3 is removed from the embodiment of the present invention illustrated in FIG. 7. Yet, the timing control unit 150 serves the same function served by the controller 128 of FIGS. 3-6, according to another embodiment of the present invention.

The timing control unit 150 supplies the deterioration data to the sampling latch 122 in the initial period of the sensing period so as to generate the intermediate voltage in the DAC 124. The deterioration data supplied to the sampling latch 122 is supplied to the DAC 124 through the holding latch 123. Then, the DAC 124 generates a voltage (e.g., a predetermined voltage) corresponding to the deterioration date and the generated voltage is supplied to the buffer 125.

Moreover, the timing control unit 150 controls bits of the deterioration data more than once, based on the compared result of the comparator 127, so that the voltage of the buffer 125 and the OLED deterioration voltage are similar to each other. In addition, the timing control unit 150 stores the deterioration data, corresponding to the deterioration information at the memory 180.

Aside from the differences noted above, the embodiment of FIG. 7 is similar to, or the same as, the previously described embodiment of FIG. 3. Therefore, further detailed description thereof will not be provided.

Meanwhile, in embodiments of the present invention, the transistors included in the pixels are illustrated as PMOSs, but embodiments of the present invention are not limited thereto. In other words, the transistors may be formed as NMOSs.

Additionally, in embodiments of the present invention, the organic light emitting diode OLED generates red light, green light, or blue light corresponding to an amount of the current supplied from a driving transistor, but the embodiments of the present invention are not limited thereto. For example, the organic light emitting diode OLED as described above generates white light corresponding to an amount of current supplied from the driving transistor. In this embodiment, color image is implemented by using a separate color filter, or the like.

As set forth above, according to embodiments of the present invention, the ADC is formed on each channel so that the deterioration information of the organic light emitting diode can be stably measured. In addition, in the embodiments of the present invention, the ADC for measuring OLED deterioration is configured to use the digital-to-analog converter for supplying the data signal, therefore, manufacturing cost and mounting area may be reduced or minimized. While the present invention has been described in connection with certain example embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting display device comprising:

pixels positioned at crossing regions between data lines and scan lines, each of the pixels comprising an organic light emitting diode;

a scan driver configured to supply a scan signal to scan lines;

a data driver configured to drive the data lines, the data driver comprising, in each channel of the data driver:

a supply part comprising a digital-to-analog converter configured to generate data signals using second data supplied from outside in a driving period, and configured to generate and output an intermediate voltage based on a deterioration data in an initial period of a sensing period, the sensing period occurring before the driving period in a frame period; and a deterioration part configured to supply a current to the organic light emitting diode to measure deterioration information of the organic light emitting diode, to control a bit value of the deterioration data supplied to the digital-to-analog converter based on the deterioration information in the sensing period, and to supply the deterioration data to the supply part; and a switching unit configured to switchably connect a corresponding data line of the data lines to the supply part in the driving period, and configured to connect the corresponding data line to the deterioration part in the sensing period.

2. The organic light emitting display device according to claim 1, wherein the supply part comprises:

a holding latch configured to store the deterioration data from the deterioration part and to store the second data;

the digital-to-analog converter, which is configured to generate an analog voltage corresponding to either the deterioration data or a data signal corresponding to the second data; and a buffer configured to output the analog voltage or the data signal.

3. The organic light emitting display device according to claim 2, wherein the deterioration data is configured to be supplied in the sensing period.

4. The organic light emitting display device according to claim 2, wherein the analog voltage generated by initial deterioration data, which is stored at the holding latch, is set to be the intermediate voltage generated in the digital-to-analog converter.

5. The organic light emitting display device according to claim 2, further comprising:

a level shifter positioned between the holding latch and the digital-to-analog converter.

6. The organic light emitting display device according to claim 2, wherein the deterioration part comprises:

a current source configured to supply a current to the organic light emitting diode through the corresponding data line in the sensing period;

a comparator coupled to the buffer and the current source, and configured to compare the analog voltage with a deterioration voltage generated at the organic light emitting diode in response to the supplied current; and a controller configured to control a bit value of the deterioration data corresponding to the compared result of the comparator.

7. The organic light emitting display device according to claim 6, wherein the controller is configured to control the bit value of the deterioration data so that the analog voltage and the deterioration voltage are similar to each other.

8. The organic light emitting display device according to claim 6, further comprising:

a memory configured to store the deterioration data, and a timing controller configured to generate the second data by changing a bit of first data so that a deterioration of the organic light emitting diode is compensated using the deterioration data.

9. The organic light emitting display device according to claim 2, wherein the deterioration part comprises:

a current source configured to supply a current to the organic light emitting diode through the corresponding data line; and a comparator coupled to the buffer and the current source, and configured to compare the analog voltage with a deterioration voltage generated at the organic light emitting diode according to the supplied current.

10. The organic light emitting display device according to claim 9, further comprising:

a timing controller configured to supply the second data to the holding latch in the driving period and to control a bit value of the deterioration data corresponding to the compared result of the comparator in the sensing period.

11. The organic light emitting display device according to claim 10, wherein the timing controller controls a bit value of the deterioration data so that the analog voltage and the deterioration voltage are similar to each other.

12. The organic light emitting display device according to claim 10, further comprising: a memory configured to store the deterioration data, and the timing controller is configured to generate the second data by changing a bit of first data so that a deterioration of the organic light emitting diode is compensated using the deterioration data stored at the memory.

13. The organic light emitting display device according to claim 10, wherein the deterioration data supplied from the timing controller is supplied to the holding latch through a sampling latch.

14. The organic light emitting display device according to claim 10, wherein the switching unit comprises, in each channel:

a first switching device coupled between the supply part and the corresponding data line and turned on in the driving period, and a second switching device coupled between the deterioration part and the corresponding data line and turned on in the sensing period.

15. The organic light emitting display device according to claim 2, wherein the switching unit comprises:

a first switching device coupled between the supply part and the corresponding data line, and configured to be turned on in the driving period; and a second switching device coupled between the deterioration part and the corresponding data line, and configured to be turned on in the sensing period.

16. A method for driving an organic light emitting device comprising:

controlling bits of deterioration data supplied to a digital-to-analog converter connected to a pixel based on deterioration information measured at the pixel, the deterioration information being measured by supplying a current to an organic light emitting diode included in the pixel;

generating an intermediate voltage based on the deterioration data in an initial period of a sensing period;

generating second data by changing first data from outside to compensate for a deterioration of the organic light emitting diode based on the deterioration data;

supplying the second data converted into a data signal using the digital-to-analog converter in a driving period to a data line by switchably connecting the data line to a supply part, the driving period occurring after the sensing period in a frame period; and connecting the data line to a deterioration part in a sensing period.

17. The method for driving an organic light emitting device according to claim 16, wherein the controlling bits of deterioration data further comprises:

supplying an initial value of the deterioration data to the digital-to-analog converter and generating an analog voltage from the digital-to-analog converter;

sensing a deterioration voltage applied to the organic light emitting diode while a current is applied to the organic light emitting diode; and changing the bits of the deterioration data so that the analog voltage and the deterioration voltage are similar to each other.

18. The method for driving an organic light emitting device according to claim 17 further comprising:

after changing the bits of the deterioration data, storing the deterioration data at a memory.

19. The method for driving an organic light emitting device according to claim 17, wherein the initial value of the deterioration data generates the analog voltage of the intermediate voltage at an output of the digital-to-analog converter.

* * * * *